US005301794A

United States Patent [19]

Tomasetig

[11] Patent Number: 5,301,794

[45] Date of Patent: Apr. 12, 1994

[54] BAR RECEIVING AND DISCHARGING DEVICE IN A SIDERURGICAL FACILITY

[75] Inventor: Giovanni Tomasetig, Butrio, Italy

[73] Assignee: Pomini Techint S.p.A., Pordenone, Italy

[21] Appl. No.: 11,356

[22] Filed: Jan. 29, 1993

[51] Int. Cl.[5] ..... B65G 47/26

[52] U.S. Cl. ..... 198/433; 198/451; 414/746.4

[58] Field of Search ..... 198/433, 448, 451, 452, 198/457; 414/746.8, 746.4

[56] References Cited

U.S. PATENT DOCUMENTS

| | | | |
|---|---|---|---|
| 3,757,927 | 9/1973 | Gable et al. | 414/746.4 X |
| 4,264,267 | 4/1981 | Lüben | 414/746.8 X |
| 4,448,298 | 5/1984 | Matsuo | 198/451 |
| 4,711,340 | 12/1987 | Duri | 198/451 |
| 4,832,177 | 5/1989 | Bolig et al. | 198/451 |
| 4,905,816 | 3/1990 | Matsuo et al. | 198/448 |
| 4,936,440 | 6/1990 | Focke et al. | 198/433 X |
| 5,143,199 | 9/1992 | Evans | 198/433 X |

FOREIGN PATENT DOCUMENTS

| | | |
|---|---|---|
| 0077951 | 5/1983 | European Pat. Off. . |
| 0189616 | 8/1986 | European Pat. Off. . |
| 465625 | 9/1928 | Fed. Rep. of Germany . |
| 2166677A | 5/1986 | United Kingdom . |

*Primary Examiner*—D. Glenn Dayoan

*Attorney, Agent, or Firm*—Hedman, Gibson & Costigan

[57] ABSTRACT

A device (10) for receiving bars (11) incoming along two parallel guides (12) in a siderurgical facility, in order to lay the bars onto a cooling bed (38) includes at least one first element (15) having, at its bottom portion, two channels (16) each of which displays a downwards orientated opening, the channels being lined up with the parallel guides (12), in order to constitute a substantial extension thereof. For each channel, shutters (23, 24) are provided in order to act as a closure for each of the openings of the channels, the shutters being supported by respective arms (17, 18) swinging arounds respective pivots (19, 20). Each of the arms (17, 18) is linked, through a respective tie-rod (27, 28), to an idle crank (29, 30) installed on a cam (31, 32) rotatably actuated by a ratiomotor (35) in order to reciprocate the shutters (23, 24) between a closed-channel position and an open-channel position.

8 Claims, 2 Drawing Sheets

BAR RECEIVING AND DISCHARGING DEVICE IN A SIDERURGICAL FACILITY

BACKGROUND OF THE INVENTION

In the siderurgical facilities for the production of metal bars, the problem is known of the bars, after being cut to their desired length, having to be deposited on a cooling bed. Usually, such bars income, in alternate fashion, along two parallel guides, coming from a cutting unit in which a continuous strand is cut into such bars. The alternate bar incoming is due to the need for interspacing the rapidly arriving bars so as to be able to perform the braking thereof with no mutual impacts, in order to lay said bars on said cooling bed with substantially zero axial speed.

OBJECTS OF THE INVENTION

The general purpose of the present invention is of providing a device for laying on a cooling bed, at prefixed time intervals, bars arriving, in alternate fashion, along two guide channels.

In order to achieve such a purpose, the present applicant devised of providing a device for receiving bars incoming along two parallel guides in a siderurgical facility, in order to discharge said bars onto a cooling bed, characterized in that said device comprises at least one first element provided, at its bottom portion, with two channels lined up with said parallel guides in order to constitute a substantial extension thereof, with each of said channels showing a downwards orientated opening running throughout its length, for each channel a shutter means being provided in order to act as a closure means for said channel opening, which shutter means are supported by respective arms swinging arounds respective pivot means parallel to, and at a higher level than, said channels, said arms being each linked, through a respective tie-rod with an idle crank installed on a cam rotatably actuated by a ratiomotor in order to reciprocate said shutter means between a closed channel position and an open channel position, in which said channel shutter means is spaced apart from said channel.

In order to make clearer the explanation of the innovative principles of the present invention, and of the advantages offered by it over the prior art, a possible, exemplifying, non-limitative embodiment thereof, in which said principles are applied is disclosed in the following with the aid of the accompanying drawings.

DETAILED DESCRIPTION OF THE PREFERRED EMBODIMENT

Figure 2:
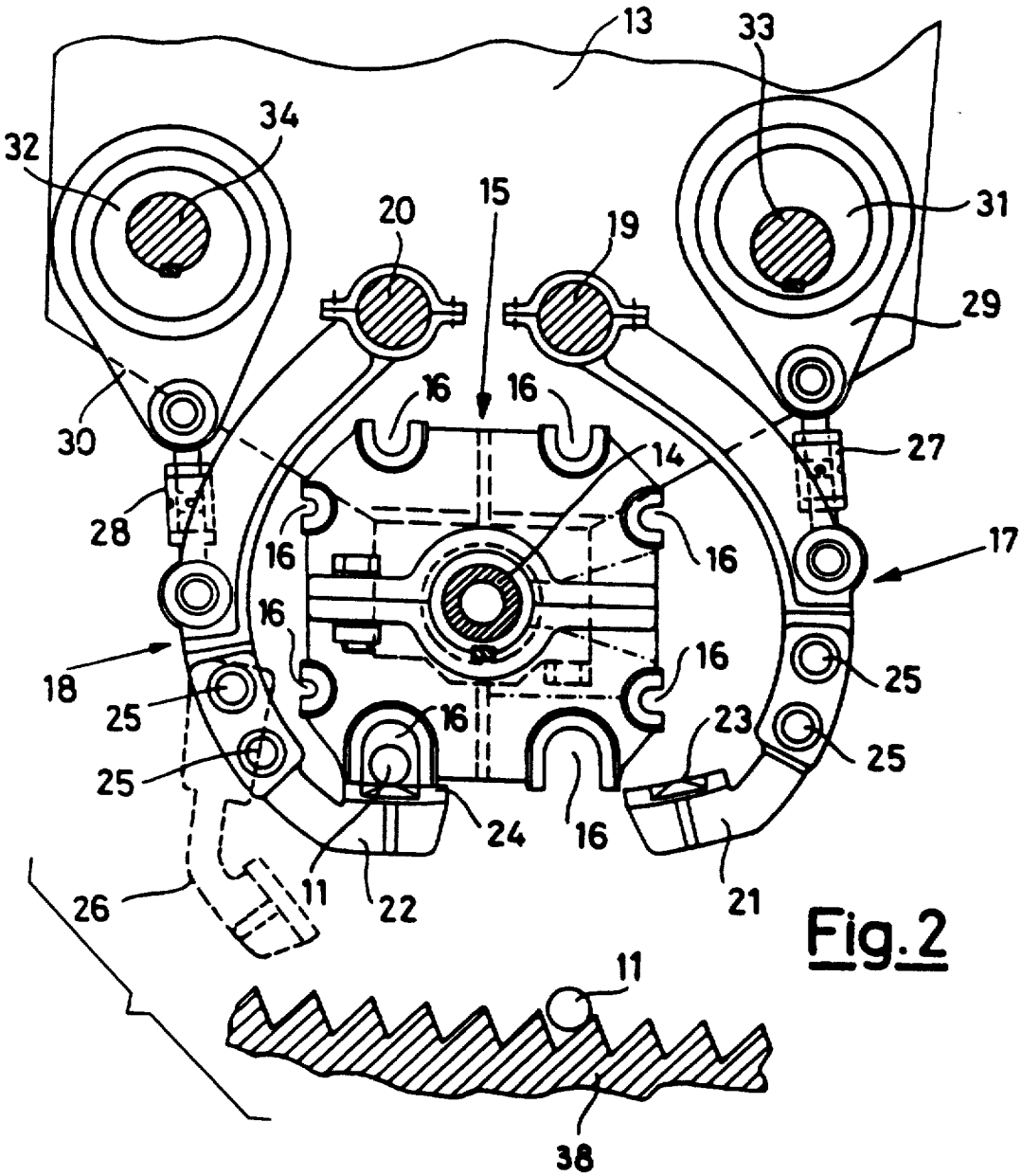
FIG. 2 represents a sectional view of FIG. 1.

Referring to the figures, a bar receiving and discharging device, generally indicated with 10, constructed according to the present invention, is fed with bar pairs 11 sequentially incoming along two parallel guides 12. Under the device 10, there is provided a cooling bed 38, known from the prior art, for example with a stepped surface as shown in FIG. 2, and moving by a pilger-pitch type of motion.

The device 10 comprises a support structure 13 bearing a shaft 14 on which first elements, i.e., drums 15 are installed, which are peripherally provided (as well shown in FIG. 2) with pairs of parallel channels 16 suitably lined with a heat refractory material. Advantageously, along a shaft 14 an axial bore runs in order to make it possible coolant water to circulate, by flowing between the ends of said shaft (a water manifold 37 is displayed in FIG. 1).

The pairs of channels provided in the drum have different cross-sections from each other. At the sides of each drum, pairs of arms 17, 18, so hinged at their top end as to be capable of freely rotating around respective pivots 19, 20, are provided. As it may also be seen in FIG. 2, the arms 17 and 18 are arcuate in order to surround the respective drum, and their bottom end ends with a support 21, 22 for tiles 23, 24 made from a known heat refractory and wear resistant material, longitudinally extending along the bottom channels of the drum. Advantageously, each support 21, 22 is fastened onto its relevant arm by means of two pins 25. In that way, a stiff assembly is obtained in which, however, the support can be caused to rotate, by gravity, in order to allow a better access during servicing, or for repairs in case of possible failures, or for removing possible pluggings, by simply removing the lower pin (as shown in dashed line, in 26).

Still in order to facilitate the structure servicing, the ends of said arms 17 and 18, which are destined to get coupled with the pivots 19 and 20, are configured as two separable parts, i.e., with a removable end cap, so that said arms 17 and 18 may be disengaged, by means of a very simple operation, from the pins 19 and 20, in order to remove, replace or service the whole tile bearing group. Such contrivances substantially facilitate the servicing, with the machine idle times being reduced, in particular because the removability of the parts overcomes the need for waiting for the machine to coot down before performing restoration interventions.

Figure 1:
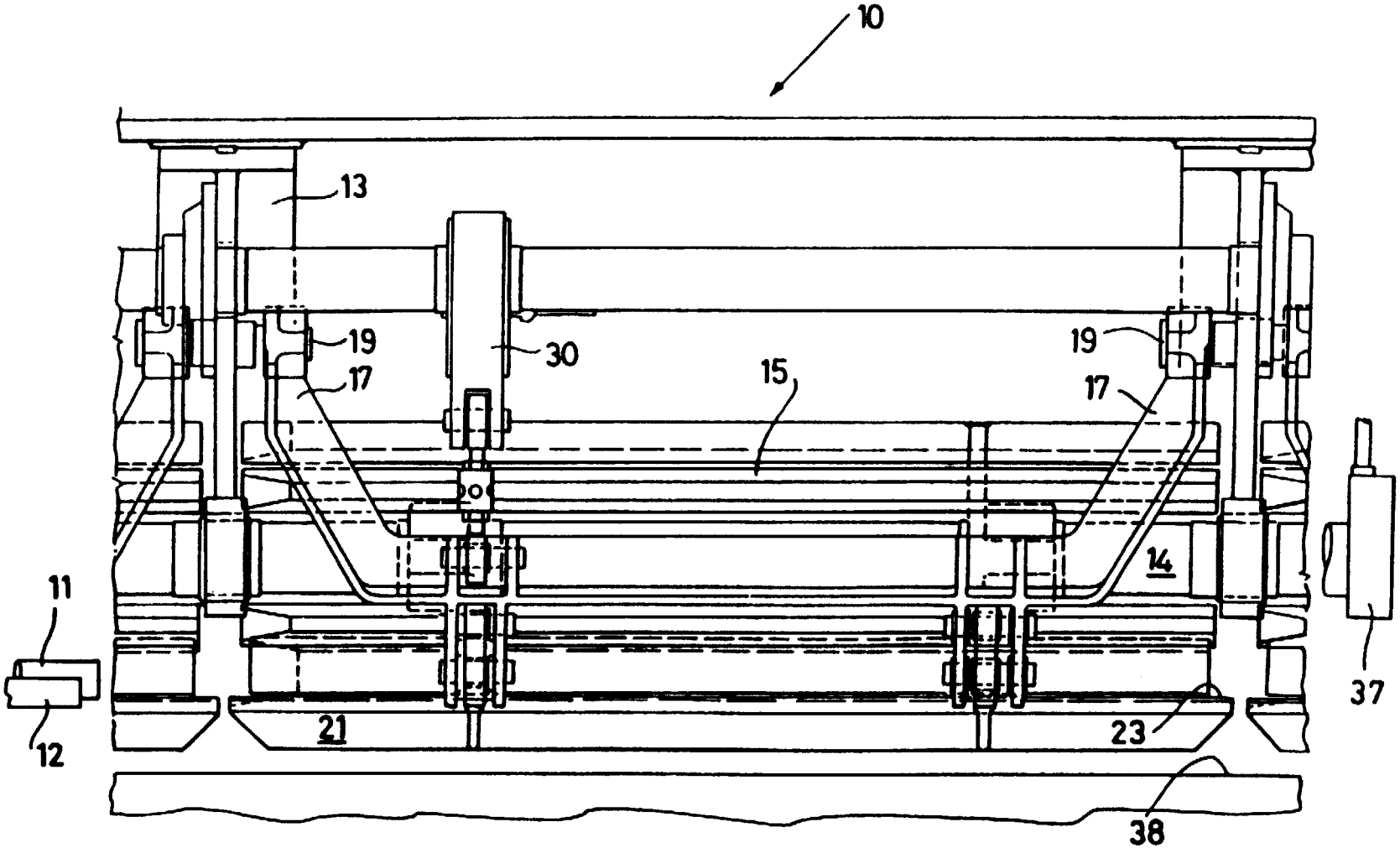
FIG. 1 represents a partial, schematic side view of a device according to the invention.

Each pair of arms 17, 18 is linked, through adjustable tie-rods 27, 28, with respective idle cranks 29, 30 installed on respective cams 31,, 32 integral with shafts 33, 34, each of which is caused to revolve by an electrical ratiomotor 35 of its own (only one of said ratiomotors is shown in FIG. 1, because the other one is identical, and symmetrically positioned, to the first one).

In such a way, when one ratiomotor 35 is started-up, all of the arm pairs installed on it will swing around the pivot 19 or 20. The cams and the adjustable tie-rods are given such dimensions that the arms may oscillate between a position (displayed on the left hand side in FIG. 2) of closure of its respective channel, and a position (displayed on the right hand side in FIG. 2) of opening of its respective channel (i.e., spaced apart from the latter).

The tie-rods are so adjusted that, in their closed-channel position, the tiles will be flush along the channel mouth.

In use, the drums 15 are so rotated as to select, at their lower side, that pair of channels which are of proper size for the bars to be processed. During the processing, the electrical motors are independently actuated, in synchronism with the incoming of the bars along the guides 12, so that the bars, which enter the channels white these are closed by the tiles, are then caused to drop onto the undertying cooling bed, from which they will be fed, in known way, to the subsequent processing steps.

As compared to the bar discharge mechanisms known from the prior art, the parts subjected to movement in the device according to the present invention have relatively small masses, a feature which, combined with the simple pendular motion of the arms, makes it possible extremely quick movements to be performed with the structure undergoing stresses of only minimal extent. So, high bar incoming speeds can be managed (e.g., 45 m/s). Furthermore, it is not necessary to reverse the revolution direction of the motors, and a simple adjustment of the motor revolution speeds allows the opening of the channels to be easily synchronized with the arrival of the bars. The additional feature of the channels being installed on rotatable drums in order that channels with different cross-section size may be brought into their operating position, endows the present bar handling facility with great flexibility and reduces to a minimum the facility idle time required when said facility has to be reconfigured in order to handle different products.

Figure 3:
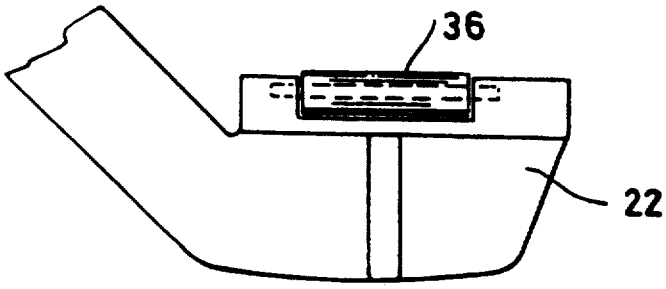
FIG. 3 represents a partial view of a possible alternative embodiment of a component of the device of FIG. 1.

In FIG. 3, a different embodiment of the channel shutting tiles is depicted, in which rollers 36 are provided lengthwise to said tiles, so as to facilitate the sliding of the bars and making it also possible bars with a rectangular cross-section to be handled.

Of course, the above disclosure made by referring to an embodiment in which the innovative principles of the present invention are applied, is reported for the only purpose of merely illustrating said innovative principles, and therefore shall not be construed as being limitative of the scope of the hereby claimed patent right.

For example, if the rapid replacement of the bar receiving channels is not required, the device can be made with fixed channels, rather than with the central, revolving drums.

Although in the drawings only two "modules", each consisting of one drum with the respective arm pairs are displayed, it will be obvious that any numbers of lined-up modules can be used, according to the length of the bars which one wishes to handle, as those skilled in the art will easily realize.

I claim:

1. Device for receiving bars incoming along two parallel guides in a sideurgicial facility, in order to discharge said bars onto a cooling bed, characterized in that said device comprises at least one first element provided, at its bottom portion, with two channels lined up with said parallel guides in order to constitute a substantial extension thereof, with each of said channels showing a downwards orientated opening running throughout its length, for each channel a shutter means being provided in order to act as a closure means for said channel opening, which shutter means are supports by respective arms swinging around respective point means parallel to, and at a higher level than, said channels, said arms being each linked, through a respective tie-rod, with an idle crank installed on a cam rotatably actuated by a ratiomotor in order to reciprocate said shutter means between a closed-channel position and an open-channel position, in which said channel shutter means is spaced apart from said channel said shutter means being supported on said arms with support elements being interposed, which are linked to the arms by means of two pins arranged spaced apart from each other along the length of said arms, in order to enable the shutter means to undergo a hinged movement, such as to move them away from the corresponding channel opening, upon one of said pins being removed.

2. Device according to claim 1 characterized in that said shutter means comprise tiles supported at the end of the arms, and extending throughout the full length of said channels.

3. Device according to claim 1, characterized in that said tie-rod has an adjustable length, in order to make it possible the closure position of said shutter means to be adjusted relatively to the channels.

4. Device according to claim 1, characterized in that two paired arms are provided per each shutter means.

5. Device according to claim 1, characterized in that said device comprises a mutually aligned plurality of said first elements, each of said mutually aligned plurality of first elements being provided with channels with substantially are the extension of the channels of the first elements.

6. Device for receiving bars incoming along two parallel guides in a sideurgicial facility, in order to discharge said bars onto a cooling bed, characterized in that said device comprises at least one first element provided, at its bottom portion, with two channels lined up with said parallel guides in order to constitute a substantial extension thereof, with each of said channels showing a downwards orientated opening running throughout its length, for each channel a shutter means being provided in order to act as a closure means for said channel opening, which shutter means are supported by respective arms swinging around respective point means parallel to, and at a higher level than, said channels, said arms being each linked, through a respective tie-rod, with an idle crank installed on a cam rotatably actuated by a ratiomotor in order to reciprocate said shutter means between a closed-channel position and an open-channel position, in which said channel shutter means is spaced apart from said channel wherein said channel containing element comprises a drum with peripherally arranged channel pairs parallel to the axis of said drum being rotatable around its axis in order to selectively move one pair of channels to their position of alignment with said guides.

7. Device according to claim 6, characterized in that along the axis of the drum a duct runs in order to allow a coolant fluid to be circulated.

8. Device for receiving bars incoming along two parallel guides in a sideurgicial facility, in order to discharge said bars onto a cooling bed, characterized in that said device comprises at least one first element provided, at its bottom portion, with two channels lined up with said parallel guides in order to constitute a substantial extension thereof, with each of said channels showing a downwards orientated opening running throughout its length, for each channel a shutter means being provided in order to act as a closure means for said channel opening, which shutter means are supported by respective arms swinging around respective point means parallel to, and at a higher level than, said channels, said arms being each linked, through a respective tie-rod, with an idle crank installed on a cam rotatably actuated by a ratiomotor in order to reciprocate said shutter means between a closed-channel position and an open-channel position, in which said channel shutter means is spaced apart from said channel wherein said shutter means comprise pluralities of parallel rollers arranged transversely to the extension of the channels, in order to supply said shutter means with sliding surfaces for the bars.

* * * * *